US005762181A

United States Patent [19]

Castonguay et al.

[11] Patent Number: 5,762,181

[45] Date of Patent: Jun. 9, 1998

[54] MEANS TO CONTROL THE OPERATING CYCLE OF AN ELECTRIC MOTOR OPERATOR FOR HIGH AMPERE-RATED CIRCUIT BREAKERS

[75] Inventors: Roger N. Castonguay, Terryville; James L. Rosen, West Hartford, both of Conn.

[73] Assignee: General Electric Company, New York, N.Y.

[21] Appl. No.: 693,935

[22] Filed: Aug. 5, 1996

[51] Int. Cl.[6] ..... H01H 5/00

[52] U.S. Cl. ..... 200/400; 200/401

[58] Field of Search ..... 200/400, 401

[56] References Cited

U.S. PATENT DOCUMENTS

| | | | |
|---|---|---|---|
| 4,001,742 | 1/1977 | Jencks et al. | 335/173 |
| 4,370,635 | 1/1983 | Carroll et al. | 200/400 |
| 5,424,701 | 6/1995 | Castonguay et al. | 335/172 |
| 5,486,667 | 1/1996 | Castonguay et al. | 200/400 |
| 5,489,755 | 2/1996 | Castonguay et al. | 200/400 |
| 5,584,383 | 12/1996 | Matsuo et al. | 200/404 |

OTHER PUBLICATIONS

British Application #P87, 407 M.A. Zaffetti, et als. Closing Arrangement for High Ampere–Rated Circuit Breakers License No.: 506,162.

U.S. Application Ser. No. 08/1315,385, Filed: Sep. 30, 1994, M. A. Zaffetti, et als. Interlock for High Ampere–Rated Circuit Breaker Closing Springs, Docket No.: 41PR–7136.

U.S. Application Ser. No. 08/220,382 (Pat. #5,545,867—Issuing on Aug. 13, 1996) Filed: Mar. 30, 1994, R.N. Castonguay et als. A Motor Operator Interface Unit for High Ampere–Rated Circuit Breakers, Docket No. 41PR–7121.

*Primary Examiner*—David J. Walczak

*Attorney, Agent, or Firm*—Richard A. Menelly; Carl B. Horton

[57] ABSTRACT

This invention relates to a high ampere-rated circuit breaker which meets the electrical code requirements of the world market. The charging of the powerful operating springs controlling the circuit breaker contacts is made automatically by means of an electric motor. The circuit breaker operating handle connects with the operating springs upon stalling of the electric motor. An electrical switching arrangement is used to remove power from the motor operator unit at the completion of the charging cycle.

8 Claims, 6 Drawing Sheets

MEANS TO CONTROL THE OPERATING CYCLE OF AN ELECTRIC MOTOR OPERATOR FOR HIGH AMPERE-RATED CIRCUIT BREAKERS

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

U.S. Pat. No. 5,424,701 entitled "Operating Mechanism for High Ampere-Rated Circuit Breakers" describes an operating mechanism capable of immediately resetting the circuit breaker operating mechanism to reclose the contacts without having to recharge the circuit breaker operating springs immediately after opening the circuit breaker contacts.

U.S. Pat. No. 5,486,667 entitled "Rating Module Unit for High Ampere-Rated Circuit Breaker" describes a circuit breaker closing spring modular unit whereby the circuit breaker operating springs are contained within a separate unit from the operating mechanism, and can be installed within the circuit breaker enclosure without disturbing the operating assembly.

U.S. Pat. No. 5,489,755 entitled "Handle Operator Assembly for High Ampere-Rated Circuit Breaker" describes a handle operator unit capable of generating large spring charging force by means of an externally-accessible manually-operated handle. A ratchet and pawl assembly allows the manually-applied charging forces to be applied to the operating springs. Once the circuit breaker operating mechanism closing springs are fully-charged, some means must be employed to release the pawl to allow the closing springs to become fully operational.

British Provisional Application No. P87,407, entitled "Closing Arrangement for High Ampere-Rated Circuit Breakers", filed Mar. 17, 1995, describes an arrangement capable of releasing the fully charged closing springs.

U.S. patent application Ser. No. 08/315,385 entitled "Interlock for High Ampere-Rated Circuit Breaker Closing Springs", filed Sep. 30, 1994, describes a closing spring interlock arrangement, which provides a method to interlock the closing springs to insure that the closing springs are released only at the appropriate time.

U.S. patent application Ser. No. 08/220,382 entitled "A Motor Operator Interface Unit for High Ampere-Rated Circuit Breakers", filed Mar. 30, 1994, describes a simplified arrangement of an electric motor mechanism to automatically charge the circuit breaker closing springs.

When charging the circuit breaker operating springs, it is desirable to have a method where the electrical power is removed from the motor operator unit at the completion of the charge cycle.

SUMMARY OF THE INVENTION

A method is shown where an electrical switch is operated by a mechanical linkage and latching system to allow electrical power to be applied selectively as required for charging the circuit breaker closing springs.

DESCRIPTION OF THE PREFERRED EMBODIMENT

Figure 1:
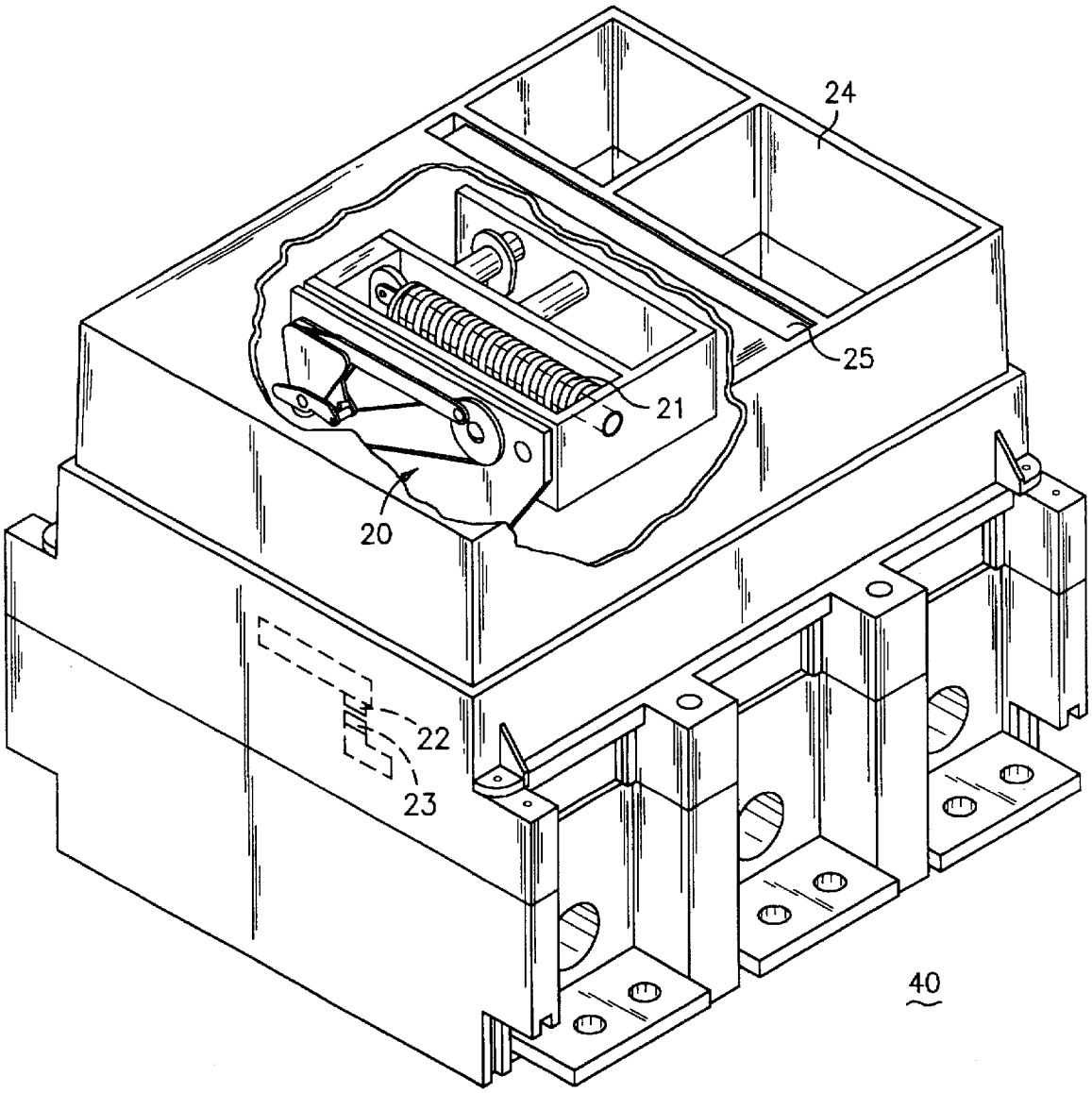
FIG. 1 is a top perspective view of a high ampere-rated circuit breaker with a portion of the circuit breaker removed to depict the motor operator interface unit used with the electric motor operator control unit according to the invention.

The motor operator interface unit 20 as in the high ampere-rated circuit breaker 40 shown in FIG. 1 is described within the aforementioned copending U.S. patent application Ser. No. 08/220,382, which is assigned to the assignee of the present invention. The motor operator interface unit 20 charges the closing spring 21 which closes the circuit breaker contacts 22, 23. The condition of the circuit breaker contacts is determined electronically by means of an electronic trip unit (not shown) which is contained within the trip unit recess 24. The contacts are also moved between their open and closed positions by means of the externally-accessible operating handles 25.

Figure 2:
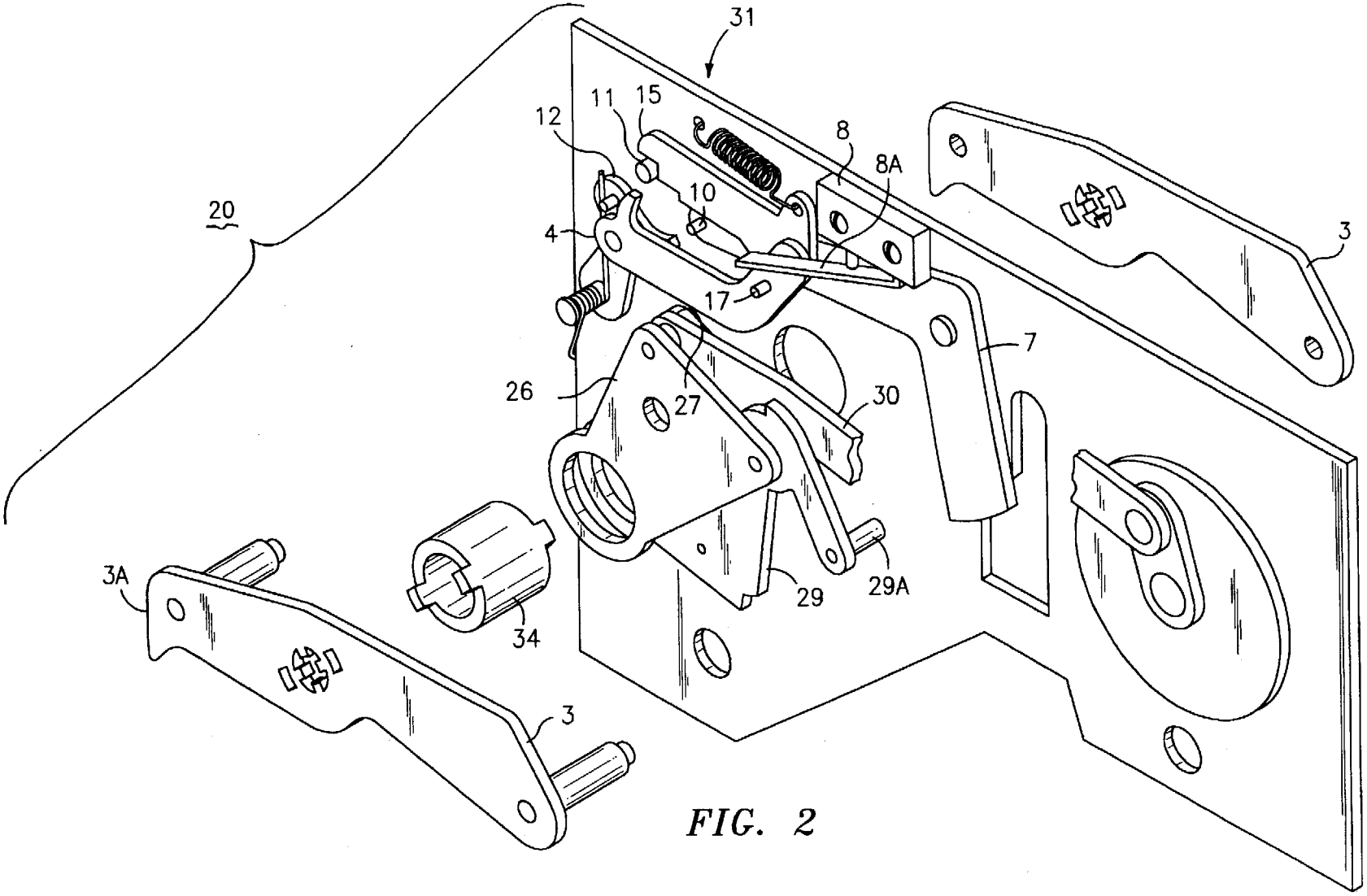
FIG. 2 is an enlarged top perspective of the motor operator of FIG. 1 with the components in isometric projection with respect to the motor operator control unit of the invention.

The motor operator interface unit 20 as shown in FIG. 2 is described within the aforementioned U.S. patent application Ser. No. 08/220,382 consisting of a pair of motor charge arms or links 3 that connect the motor drive plates 26, 27, pivot sleeve 34, friction clutch plate 29 and the drive link 30. In accordance with the invention, the electric motor operator control unit 31 interfaces between the logic arm 7 and the motor charge link 3 to interrupt current to the associated motor (not shown) by means of the cut-out switch 8. The operational logic relating to the position of the closing spring charging motor (not shown) and the condition of the closing spring 21 of FIG. 1 is supplied by the end 3A of the motor charge link 3 and the pin 29A extending from the friction clutch plate 29. The logic arm 7 interacts with the pin 29A at one end while the logic arm pin 10 on the logic arm interacts with the latch 15 and latch retainer pin 11 at the opposite end of the logic arm. The end 3A of the motor charge link 3 interacts with the reset arm 12 to drive switch actuator pin 17 on the switch pivot arm 4 into contact with the switch activator arm 8A on the cut-out switch 8 in the manner to be shown below with references to FIGS. 3–6.

Figure 3:
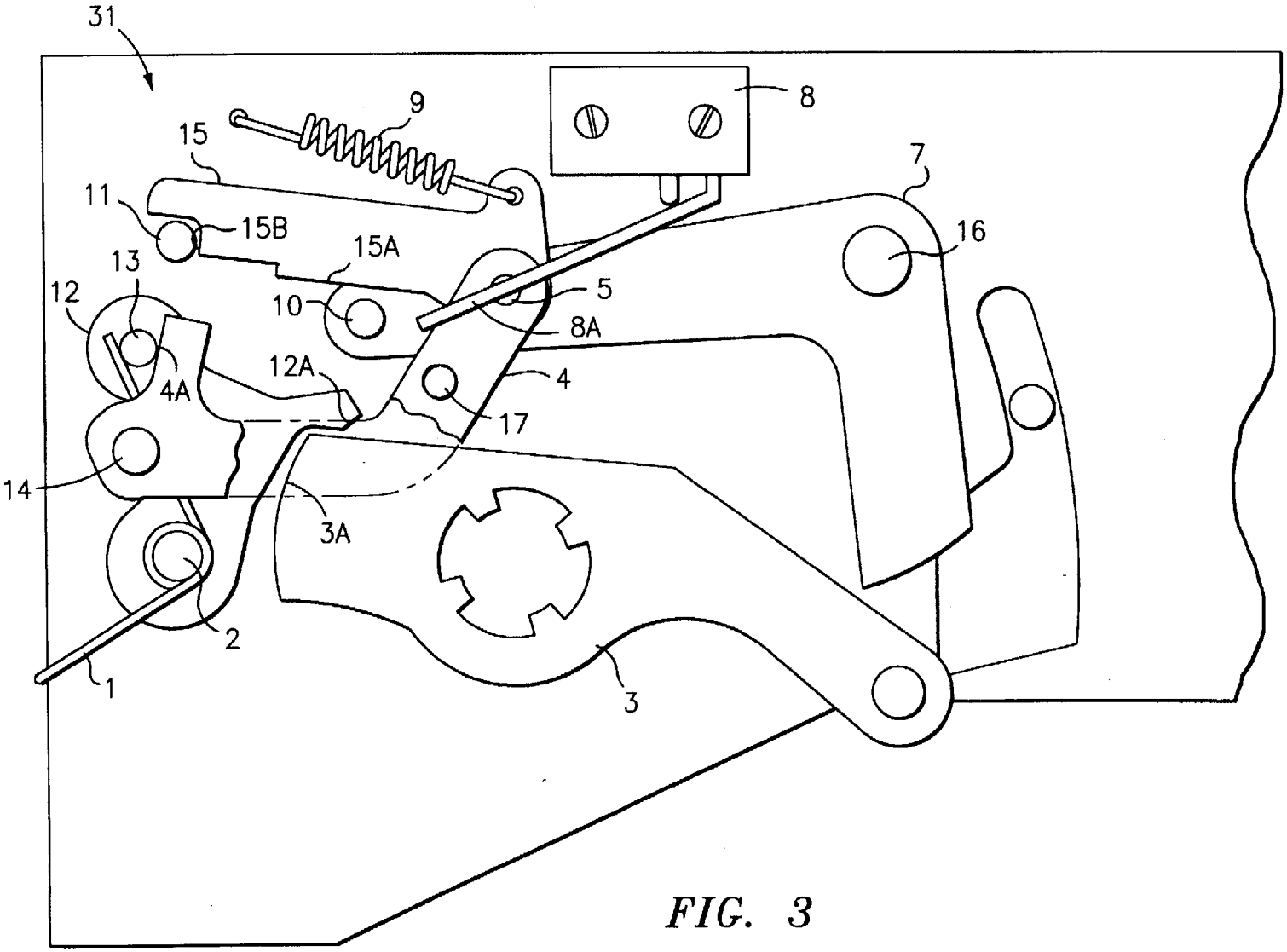
FIG. 3 is an enlarged plan side view of the motor operator control unit of FIG. 2 when the circuit breaker closing spring is discharged and the cut-out switch is in a normally closed condition.

FIG. 3 depicts the positional relationship within the motor control unit 31 when the circuit breaker closing spring is discharged and with the motor charge link 3 is in its counter-clockwise discharged position. The logic arm pin 10 extending from the logic arm 7 is rotated counter-clockwise about pivot pin 16 such that the logic arm pin 10 is out-of-engagement with the surface 15*a* on the bottom of latch 15. In this position, the surface 12*a* of reset arm 12 clears the end 3*a* at the end of the charge link 3, which allows the reset spring 1 (arranged around reset arm post 2) to rotate the reset pin 13 clockwise, forcing the reset pin against the surface 4*a* of the switch pivot arm 4, rotating the switch pivot arm clockwise about the switch pivot pin 14. The switch actuator pin 17, which is attached to switch pivot arm 4, rotates clockwise out-of-engagement with the switch actuator arm 8*a* of switch 8, allowing the electrical contacts of the normally-closed cut-out switch 8 to close, which allows the motor to operate. It is noted that the surface of the latch 15 rests against the latch retainer pin 11 shown earlier in FIG. 2, and the latch return spring 9 is extended.

Figure 4:
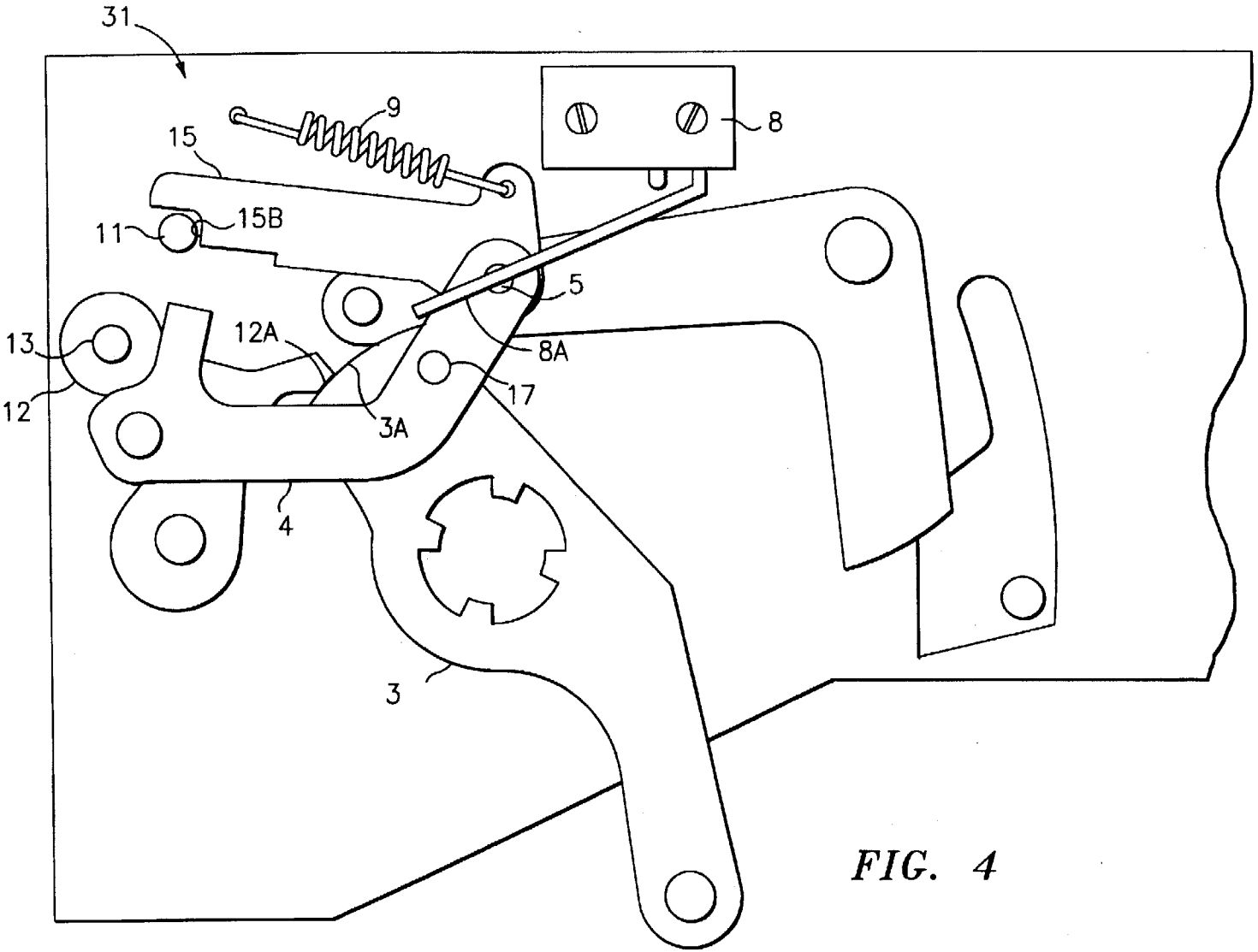
FIG. 4, is an enlarged plan side view of the motor operator control unit when the circuit breaker closing spring is fully charged and with the motor operator still engaged.

FIG. 4 depicts the positional relationship of the motor control unit 31 when the circuit breaker closing spring is fully charged and the motor mechanism is not disengaged. The motor charge link 3 is rotated in a clockwise charging direction, which brings the end 3*a* at the end of the motor charge link 3 into contact with surface 12*a* on the reset arm 12, rotating the reset arm and the reset pin 13 counter-clockwise, releasing the switch pivot arm 4 and allowing the switch pivot arm to rotate counter-clockwise under the bias provided by the latch return spring 9. Latch 15, which is attached to the switch pivot arm 4 by means of the latch pivot pin 5, is rotated counter-clockwise until surface 15*b* of the latch engages the latch retainer pin 11, blocking the switch pivot arm 4 from rotating as shown in FIG. 3. With the switch pivot arm 4 blocked from rotating, the switch actuator pin 17 is held out of engagement with the switch actuator arm 8*a* of the cut-out switch 8 keeping the cut-out switch closed and the associated motor operational.

Figure 5:
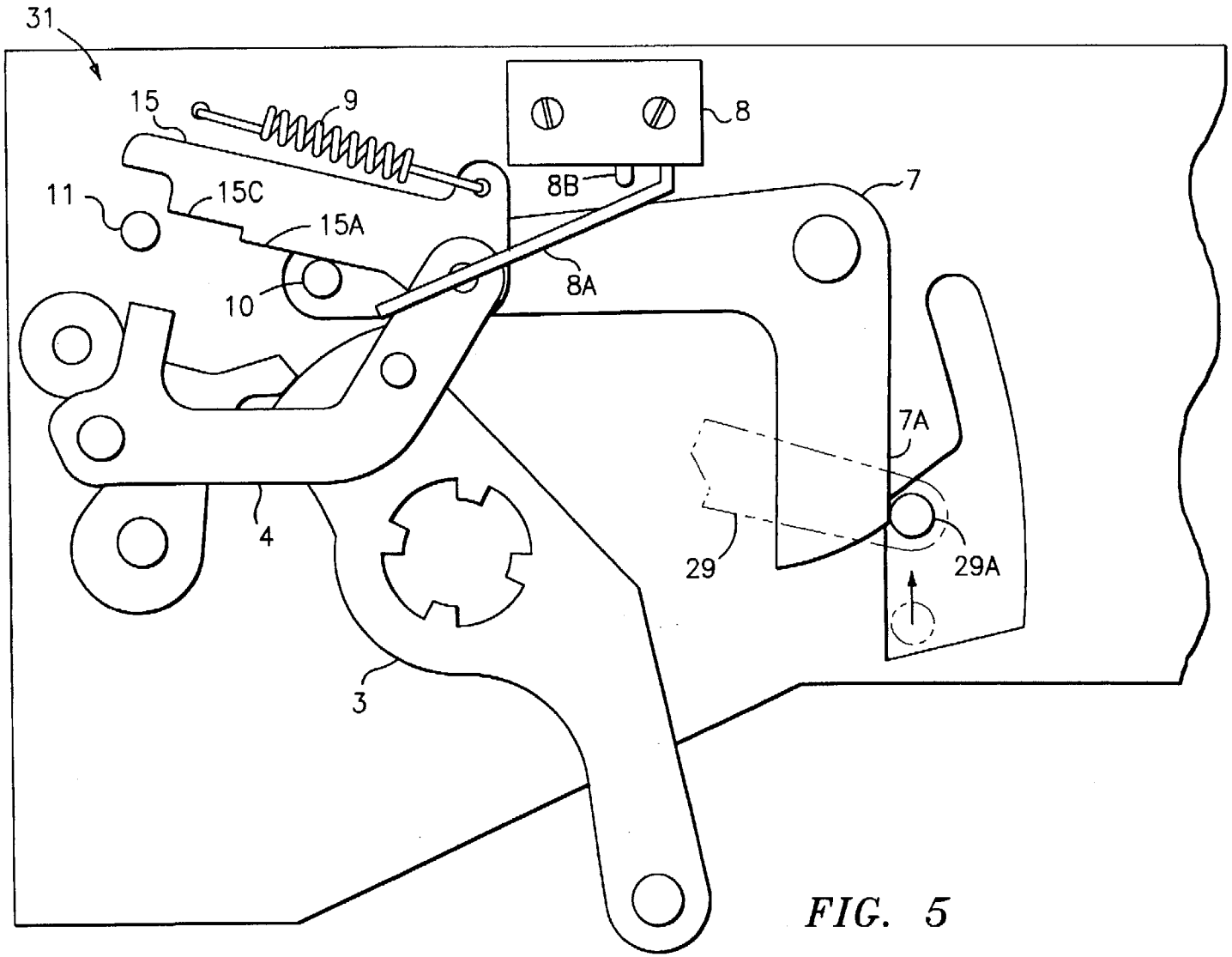
FIG. 5 is an enlarged plan side view of the motor operator control unit when the circuit breaker closing spring is fully charged and the cut-out switch un-activated.

In the positional arrangement of the motor operator control unit 31 depicted in FIG. 5, the closing spring 21 (shown in FIG. 1) is fully charged, and the latch 15 is disengaged from the latch retainer pin 11. The motor charge link 3 is in its fully clockwise charged position wherein the drive pin 29A at the end of the friction clutch plate 29, shown partially in phantom, moves into engagement with surface 7*a* of logic arm 7 as described in aforementioned copending U.S. patent application Ser. No. 08/220,382, rotating the logic arm clockwise. This forces logic arm pin 10 into engagement with surface 15*a* of latch 15, causing latch 15 to rotate clockwise out-of-engagement with latch retainer pin 11. This releases the switch pivot arm 4 to rotate counter-clockwise under the bias force from the switch return spring 9, as the surface 15*c* of latch 15 slides along latch retainer pin 11. The actuator arm 8A is out of contact with the button 8B on switch 8.

Figure 6:
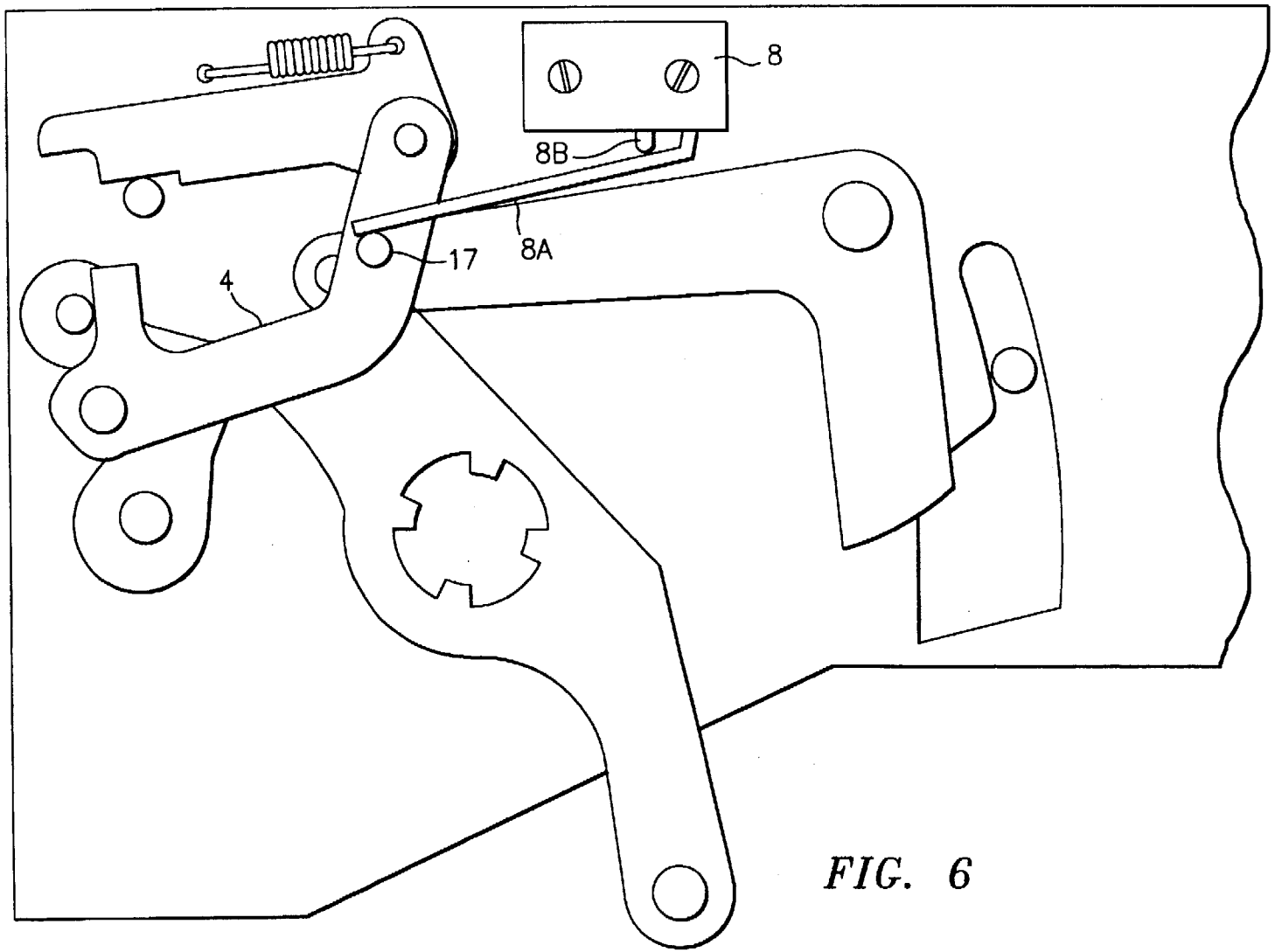
FIG. 6 is an enlarged plan side view of the motor operator control unit when the circuit breaker closing spring is fully charged and the cut-out switch is activated.

In FIG. 6, the closing spring 21 (shown in FIG. 1) is fully charged, the switch 8 is driven to an open position and the counter-clockwise rotation of the switch pivot arm 4 is complete. The switch actuator pin 17 has now engaged the actuator arm 8*a* of switch 8, moving it into contact with the button 8B to open the switch contacts and de-energize the closing spring charging motor as previously described.

We claim:

1. A circuit breaker charging motor control unit comprising:

a motor cut-out switch connected in series with an electric charging motor;

a reset arm pivotally attached to a support frame and arranged for interacting with an end of a circuit breaker closing spring motor operator charge link;

a logic arm attached to said support frame and arranged for interacting with an circuit breaker closing spring motor operator friction clutch plate;

a latch arm and a latch pin, said latch arm connected with said logic arm and said latch pin connected with said latch arm for preventing operation of said motor cut-out switch until said motor has completely charged said closing spring; and a switch pivot arm connecting with said latch arm at one end and interacting with said reset arm at an opposite end, wherein said switch pivot arm includes a switch actuator pin extending therefrom intermediate said one end and said opposite end, said switch pin arranged for engaging a switch actuator arm to actuate said motor cut-out switch when said electric charging motor has completed charging said circuit breaker closing spring.

2. The circuit breaker charging motor control unit of claim 1 wherein said motor cut-out switch contains normally closed contacts.

3. The circuit breaker charging motor control unit of claim 1 including a latch arm return spring biasing said latch arm into abutment with said latch pin when said closing spring is in an uncharged as well as in a charged condition.

4. A circuit breaker charging motor control unit comprising:

a motor cut-out switch connected in series with an electric charging motor;

a reset arm pivotally attached to a support frame and arranged for interacting with an end of a circuit breaker closing spring motor operator charge link;

a logic arm attached to said support frame and arranged for interacting with an circuit breaker closing spring motor operator friction clutch plate;

a latch arm and a latch pin, said latch arm connected with said logic arm and said latch pin connected with said latch arm for preventing operation of said motor cut-out switch until said motor has completely charged said closing spring; and a reset spring biasing said reset arm into abutment with said end of said circuit breaker closing spring motor operator charge link.

5. A circuit breaker having a case and a cover;

a pair of separable contacts within said case for allowing current transfer within and associated electric circuit;

a closing spring within said cover and arranged for moving said contacts into a closed condition;

a motor control unit including a motor charge link and a motor friction clutch plate for moving said closing spring from an uncharged to a fully-charged condition;

a motor cut-out switch connected in series with an electric charging motor;

a reset arm pivotally attached to a support frame and arranged for interacting with an end of a circuit breaker closing spring motor operator charge link;

a logic arm attached to a support frame within said case and arranged for interacting with said circuit breaker closing spring motor operator friction clutch plate;

a latch arm and a latch pin, said latch arm connected with said logic arm and said latch pin connected with said latch arm for preventing operation of said motor cut-out switch until said motor has completely charged said closing spring; and a switch pivot arm connecting with said latch arm at one end and interacting with said reset arm at an opposite end, said switch pivot arm includes a switch actuator pin extending therefrom intermediate said one end and said opposite end, said switch pin arranged for engaging a switch actuator arm to actuate said motor cut-out switch when said electric charging motor has completed charging said circuit breaker closing spring.

6. The circuit breaker of claim 5 wherein said motor cut-out switch contains normally closed contacts.

7. The circuit breaker of claim 5 including a latch arm return spring biasing said latch arm into abutment with said latch pin when said closing spring is in an uncharged condition.

8. A circuit breaker having a case and a cover;

a pair of separable contacts within said case for allowing current transfer within and associated electric circuit;

a closing spring within said cover and arranged for moving said contacts into a closed condition;

a motor control unit including a motor charge link and a motor friction clutch plate for moving said closing spring from an uncharged to a fully-charged condition;

a motor cut-out switch connected in series with an electric charging motor;

a reset arm pivotally attached to a support frame and arranged for interacting with an end of a circuit breaker closing spring motor operator charge link;

a logic arm attached to a support frame within said case and arranged for interacting with said circuit breaker closing spring motor operator friction clutch plate;

a latch arm and a latch pin, said latch arm connected with said logic arm and said latch pin connected with said latch arm for preventing operation of said motor cut-off switch until said motor until said motor has completely charged said closing spring; and a switch pivot arm connecting with said latch arm at one end and interacting with said reset arm at an opposite end, said motor cut-out switch containing normally closed contacts; and a reset spring biasing said reset arm into abutment with said end of said circuit breaker closing spring motor operator charge link.

* * * * *

UNITED STATES PATENT AND TRADEMARK OFFICE

CERTIFICATE OF CORRECTION

PATENT NO. : 5,762,181

DATED : June 9, 1998

INVENTOR(S) : Roger N. Castonguay; James L. Rosen

It is certified that error appears in the above-identified patent and that said Letters Patent is hereby corrected as shown below:

On the title page, Item [56] please insert the following:

--Related U.S. Application Data--
--Provisional application No. 60/002,181 filed Aug. 11, 1995.--

Please insert at column 1, line 5, after the title and before the sub-title "Background of the Invention":

-- Pursuant to 35 U.S.C. Section 119(e)(1), this patent is entitled to priority based on the United States Provisional Patent application Ser. No. 60/002,181 filed on Aug. 11, 1995.--

Signed and Sealed this

First Day of June, 1999

*Attest:*

Q. TODD DICKINSON

*Attesting Officer*

*Acting Commissioner of Patents and Trademarks*